US009321258B2

(12) United States Patent
Weber et al.

(10) Patent No.: US 9,321,258 B2
(45) Date of Patent: Apr. 26, 2016

(54) FOIL TRANSFER DEVICE

(71) Applicant: HEIDELBERGER DRUCKMASCHINEN AG, Heidelberg (DE)

(72) Inventors: Alexander Weber, Weinheim (DE); Oliver Wuehler, Mannheim (DE); Juergen Baecker, Nussloch (DE); Hansjoerg Klein, Aichwald (DE); Joerg Duemmel, Neuffen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/328,940

(22) Filed: Jul. 11, 2014

(65) Prior Publication Data

US 2015/0020702 A1 Jan. 22, 2015

(30) Foreign Application Priority Data

Jul. 17, 2013 (DE) ..... 10 2013 011 885

(51) Int. Cl.
*B41F 19/00* (2006.01)
*B41F 19/06* (2006.01)
*B41F 16/00* (2006.01)

(52) U.S. Cl.
CPC ..... *B41F 19/001* (2013.01); *B41F 16/00* (2013.01); *B41F 16/0033* (2013.01); *B41F 19/004* (2013.01); *B41F 19/062* (2013.01); *Y10T 156/1705* (2015.01)

(58) Field of Classification Search
CPC .... B41F 16/00; B41F 16/0033; B41F 19/001; B41F 19/004; B41F 19/062; Y10T 156/1705
See application file for complete search history.

(56) References Cited

U.S. PATENT DOCUMENTS

| | | | | | |
|---|---|---|---|---|---|
| 5,598,779 | A * | 2/1997 | Haas et al. | 101/230 |
| 5,605,597 | A * | 2/1997 | Plenzler | 156/499 |
| 5,611,272 | A * | 3/1997 | Steuer | 101/23 |
| 6,171,429 | B1 | 1/2001 | Aindow et al. | |
| 2002/0112618 | A1 * | 8/2002 | Bailey et al. | 101/2 |
| 2008/0196662 | A1 * | 8/2008 | Reschke et al. | 118/500 |
| 2008/0271836 | A1 * | 11/2008 | Richter et al. | 156/233 |
| 2011/0198785 | A1 * | 8/2011 | Kester et al. | 264/642 |
| 2012/0152444 | A1 * | 6/2012 | Weber | 156/219 |
| 2013/0087290 | A1 * | 4/2013 | Ohsawa | 156/361 |

FOREIGN PATENT DOCUMENTS

| | | | | |
|---|---|---|---|---|
| DE | 29517315 | * | 12/1995 | B41F 19/00 |
| DE | 102006004094 | A1 | 8/2006 | |
| EP | 1676702 | A1 | 7/2006 | |
| WO | 9637368 | A1 | 11/1996 | |

* cited by examiner

*Primary Examiner* — Blake A Tankersley
*Assistant Examiner* — Marissa Ferguson Samreth
(74) *Attorney, Agent, or Firm* — Laurence A. Greenberg; Werner H. Stemer; Ralph E. Locher

(57) ABSTRACT

A foil transfer device includes an impression cylinder for transporting a printing substrate, a pressure cylinder for pressing a foil web against the printing substrate on the impression cylinder in a transfer nip jointly formed by the pressure cylinder and the impression cylinder, a blower device blowing into an exit region of the transfer nip, and a deflection element for deflecting the foil web. The deflection element is disposed in such a way that the foil web has a web section freely extending from the pressure cylinder to the deflection element. The blower device is disposed on the same side of the foil web as the impression cylinder.

8 Claims, 2 Drawing Sheets

FOIL TRANSFER DEVICE

CROSS-REFERENCE TO RELATED APPLICATION

This application claims the priority, under 35 U.S.C. §119, of German Patent Application DE 10 2013 011 885.9, filed Jul. 17, 2013; the prior application is herewith incorporated by reference in its entirety.

BACKGROUND OF THE INVENTION

Field of the Invention

The present invention relates to a foil transfer device for transferring foil to printing substrates.

A multi-layer foil web is used for laminating purposes. A foil layer is transferred to the printing substrate in a transfer nip. The transfer nip is formed by an impression cylinder and a pressure cylinder around which the foil web is wrapped. In the transfer nip, the pressure cylinder presses the foil web against the printing substrate, which is transported on the impression cylinder.

German Patent Application DE10 2006 004 094 A1, corresponding to U.S. Patent Application Publication No. 2008/0196662 A1, discloses a device in which a blower device for blowing between the foil web and the impression cylinder is disposed on the entry side of the transfer nip. A support plate to which blown air is applied is disposed on the exit side of the transfer nip. The support plate is located between the foil web and the pressure cylinder, i.e. on the side of the foil web opposite the impression cylinder.

European Patent Application EP 1 676 702 A1 discloses a device in which a blast-air bar is provided on the exit side of the transfer nip. The blast-air bar introduces an air blast between the foil web and the pressure cylinder. The blast-air bar is situated on the same side of the foil web as the pressure cylinder and opposite the impression cylinder.

German Utility Model DE 295 17 315 U1 discloses a foil transfer device in which an air blade is directed towards the transfer foil exiting the transfer nip. The air blade is directed to the transfer foil within a web section that is wrapped around the pressure cylinder, i.e. the web section is not a free web section.

A disadvantage of foil transfer devices is that the foil web follows the printing substrate. In other words, when the foil web exits the transfer nip, it sticks to the printing substrate, deteriorating the quality of the transferred layer of foil. A known countermeasure has heretofore been to increase the web tension in the foil web. That measure, however, caused other disadvantages such as cross-waves in the foil web.

SUMMARY OF THE INVENTION

It is accordingly an object of the invention to provide a foil transfer device, which overcomes the hereinafore-mentioned disadvantages of the heretofore-known devices of this general type.

With the foregoing and other objects in view there is provided, in accordance with the invention, a foil transfer device, comprising an impression cylinder for transporting a printing substrate, a pressure cylinder for pressing a foil web against the printing substrate on the impression cylinder in a transfer nip jointly formed by the pressure cylinder and the impression cylinder, and a blower device for blowing into an exit side region downstream of the transfer nip, the blower device disposed on the same side of the foil web as the impression cylinder, and a deflection element for deflecting the foil web, the deflection element disposed in such a way that the foil web has a free web section extending from the pressure cylinder to the deflection element.

An advantage of the invention is that the blower device assists the detachment of the foil web from the printing substrate to avoid negative effects on the quality of the transfer. Increasing the web tension as a measure to prevent the foil from sticking to the printing substrate is no longer necessary and the problems that are otherwise to be feared due to an increased web tension, such as cross-waves, are avoided.

Other features which are considered as characteristic for the invention are set forth in the appended claims.

Although the invention is illustrated and described herein as embodied in a foil transfer device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
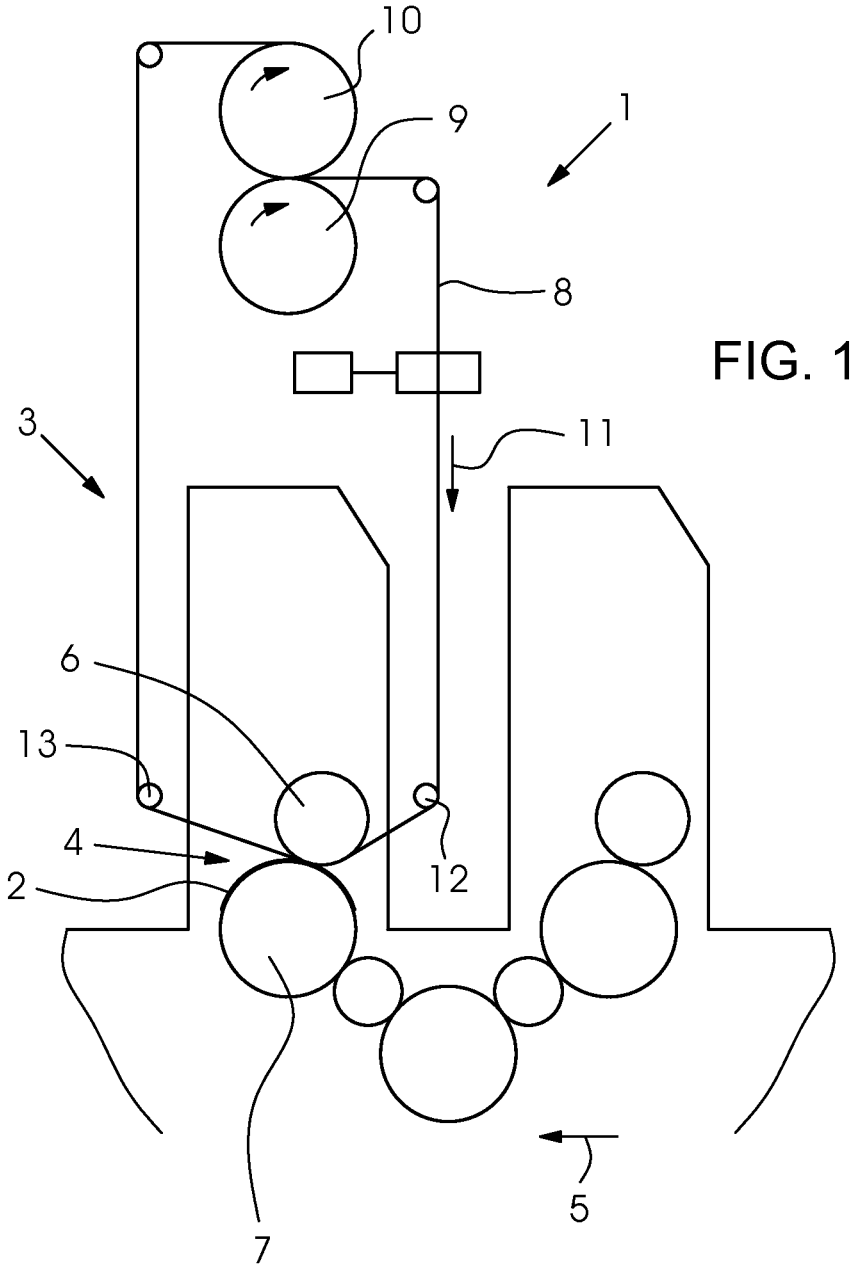
FIG. 1 is a fragmentary, diagrammatic, longitudinal-sectional view of a foil transfer device of a printing press.

Referring now to the figures of the drawings in detail and first, particularly, to FIG. 1 thereof, there is seen a section of a printing press 1 for planographic offset printing on sheets 2, which may also be referred to as printing substrates. The section includes a foil transfer device 3 for laminating the sheets 2 in a transfer nip 4. The sheets 2 receive a printed image in one or more (non-illustrated) printing units provided upstream and/or downstream of the foil transfer device 3 in the printing press, as viewed in a direction of sheet travel 5.

The transfer nip 4 is jointly formed by a pressure cylinder 6 and an impression cylinder 7. In the laminating process carried out in the transfer nip 4, a foil layer or pieces of a foil layer is/are transferred from a multi-layer foil web 8 to the sheet 2 to which glue has been applied or which has been partially coated with glue. The foil web 8 is a compound foil including the foil layer to be transferred (transfer layer), a carrier foil (carrier layer) and a release layer potentially disposed therebetween to facilitate the detachment of the foil layer from the carrier layer. The foil web 8 wraps around the pressure or contact cylinder 6, which presses the foil web 8 against the sheet 2 transported on the impression cylinder 7. The sheet 2 is held on the impression or counter pressure cylinder 7 by using grippers that clamp the leading edge of the sheet 2 or hold it by suction. The transfer of the foil layer occurs by pressure only, without any application of heat, i.e. the foil transfer device 3 is a cold-foil transfer device.

The foil transfer device 3 includes a supply reel 9 with an unused section of the foil web 8 on an unwinding core and a collecting reel 10 with a wind-up core carrying a used section of the foil web 8 from which pieces of the transfer layer have been detached in the transfer nip 4.

The foil web 8 is transported from the supply reel 9 to the collecting reel 10 through the transfer nip 4 in a direction of foil transport 11, passing a first guide element or first deflection element 12 upstream of the transfer nip 4 and a second guide element or second deflection element 13 downstream of the transfer nip 4. The two deflection elements or deflectors 12, 13 are deflection rollers. In order to minimize friction between the second deflection element 13 and the foil web 8, compressed air is applied to the second deflection element 13 from inside or the second deflection element 13 is pneumatically charged from inside. The second deflection element 13 is, in particular, a deflection roller with an air-permeable micro-porous roller jacket through which the compressed air passes from the interior of the roller to the outer circumferential surface of the roller where the exiting compressed air forms an air cushion between the second deflection element 13 or rather its circumferential surface, and the foil web 8.

Figure 2:
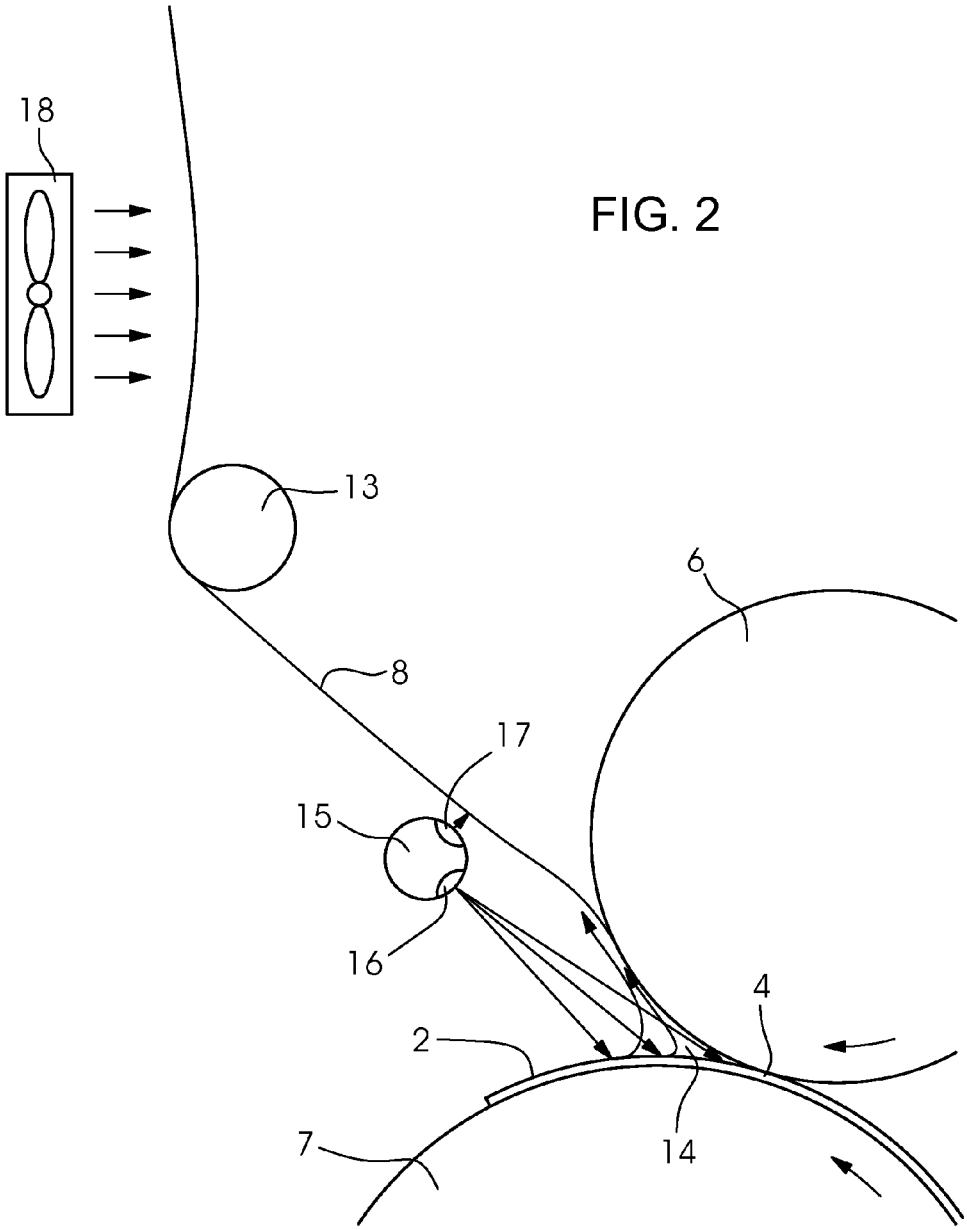
FIG. 2 is an enlarged, fragmentary, sectional view showing a blower device of the foil transfer device shown in FIG. 1.

Once the foil has been transferred, the sheet 2 and the foil web 8 still adhering thereto exit the transfer nip 4 together. As seen in FIG. 2, the sheet 2 and the foil web 8 detach from each other in an exit region 14 located downstream of the transfer nip 4 as viewed in the direction of rotation of the cylinders 6, 7 or in the direction of transport of the foil web 8 or sheet 2. The exit region 14 is formed by the diverging circumferential surfaces of the two cylinders 6, 7. The sheet 2, including its front edge, rests on the impression cylinder 7. The detachment occurs at a detachment location following the transfer nip 4 in the direction of rotation of the impression cylinder 7. The stronger the adhesion between the foil web 8 and the sheet 2, the greater the circumferential angle region of the impression cylinder 7 located between the transfer nip 4 and the detachment location, which may be referred to as the follow angle. This follow angle needs to be minimized in order to avoid negative effects on the foil transfer.

A blower device or blower 15 is directed towards the exit region 14 in order to counteract the adhesion between the foil and the sheet. The blower device 15 is a blast pipe equipped with first blowing openings 16, which are disposed in a row perpendicular to the plane of the drawing of FIG. 2. Each opening 16 is equidistantly spaced apart from the next opening. The blowing openings 16 may be bores having a diameter ranging between 1.5 mm and 3.0 mm or nozzles having a diameter ranging between 1.5 mm and 5.0 mm, preferably between 2.5 mm and 4.0 mm. As indicated by the arrows in the drawing leading out of the first blowing openings 16, the blower device 15 emits blown air in the direction of the transfer nip 4, i.e. into the wedge-shaped space between the foil web 8 and the sheet 2 on the impression cylinder 7. The blowing direction of the blower device 15 or of the first blowing openings 16 is almost parallel to the foil web 8 or inclined at an acute angle relative thereto. The blower device 15 forms an air blade and the emitted blown air peels the foil web 8 off the sheet 2.

At least a major part of the blast-air cone of the respective first blowing opening 16 meets the sheet 2, accumulates thereon and is deflected by the sheet 2, causing a resultant back pressure of the blown air in the exit region 14 and between the sheet 2 and the foil web 8 to assist the detachment of the foil web 8 from the sheet 2. The accumulated or deflected blown air urges the foil web 8 towards the pressure cylinder 6.

The blower device 15 or the first blower openings 16 may be adjustable in terms of the angle of their blowing direction. For example, an operator may rotate or pivot them within a limited angular range. The angular adjustment may be made as a function of other parameters such as the stability of the foil web. The emitted flow rate may be 70 to 150 $m^3/h$ and may be adjustable by an operator at a (non-illustrated) control device for the blower device 15. Alternatively, the flow rate may be controlled as a function of the machine speed on the basis of a characteristic curve stored in the control device.

The blower device 15 may be connected to a temperature control device. The blown air emitted by the blower device 15 or the first blowing openings 16 may be temperature-controlled, i.e. it may be warm air to accelerate the drying of the glue on the sheet 2 and to assist the detachment of the foil web 8 from the sheet 2. The emitted blown air may be ionized to reduce electrostatic charging when the transfer layer is released. For this purpose, a de-electrification device may be provided in the exit region 14, for instance in the form of a de-electrification bar parallel to the blower device 15.

The blower device 15 includes second blowing openings 17 disposed in a row that is perpendicular to the plane of the image of FIG. 2, with all openings 17 equidistantly spaced apart from the adjacent opening 17. The second blowing openings 17 are oriented in a different direction than the first blowing openings 16 and may be referred to as cross-blowing openings. The second blowing openings 17 are directed towards the foil web 8 in such a way that the blown air emitted by the second blowing openings 17 hits the foil web 8 at a right angle as indicated by an arrow in the drawing. The second blowing openings 17 blow onto the foil web 8 in a web section that extends from the transfer nip 4 to the second deflection element 13. To be more exact, the second blowing openings 17 blow onto the foil web 8 in a free web section extending from the pressure cylinder 6 to the deflection element 13. The blown air emitted by the second blowing openings 17 has a positive effect on the follow behavior of the foil web 8. The lower the tension in the foil web, the more pronounced the positive effect. Moreover, the second blowing openings 17 act as a protection of the blower device 15 against being hit by the foil web 8.

A further blower device 18, which is constructed as a row of aerators or might alternatively be constructed as a blowing chamber, is provided downstream of the second deflection element 13 as viewed in the direction of foil transport 11. The second blower device 18 is directed towards the foil web 8, specifically onto the side thereof that has the transfer layer. The second blower device 18 blows onto the foil web 8, causing the foil web 8 to be deflected to re-increase the web tension in the foil web 8 to the required level if the web tension has dropped in an undesired way.

The invention claimed is:

1. A foil transfer device, comprising:

an impression cylinder disposed on one side of a foil web and configured to transport a printing substrate;

a pressure cylinder configured to press the foil web against the printing substrate on said impression cylinder in a transfer nip jointly formed by said pressure cylinder and said impression cylinder;

a deflector configured and disposed to deflect the foil web and to provide the foil web with a web section freely extending from said pressure cylinder to said deflector; and a blower disposed on the same one side of the foil web as said impression cylinder and configured to blow into an exit region of the transfer nip, said blower having first blowing openings with a blowing direction oriented towards the printing substrate on said impression cylinder and second blowing openings oriented perpendicular to said first blowing openings, said second blowing openings blowing onto the foil web within the web section extending freely from said pressure cylinder to said deflector.

2. The foil transfer device according to claim 1, wherein said blower is disposed between the foil web and said impression cylinder.

3. The foil transfer device according to claim 1, wherein said blower forms an air blade configured to peel the foil web off the printing substrate.

4. The foil transfer device according to claim 1, wherein said blower has an angularly adjustable blowing direction.

5. The foil transfer device according to claim 1, wherein said blower emits temperature-controlled blown air.

6. The foil transfer device according to claim 1, wherein said blower emits ionized blown air.

7. The foil transfer device according to claim 1, which further comprises a further blower disposed downstream of said deflector in a transport direction of the foil web and configured to blow onto the foil web.

8. The foil transfer device according to claim 1, wherein said first blowing openings blow more onto the printing substrate on the impression cylinder than onto the foil web on the pressure cylinder.

* * * * *